US007956816B2

(12) United States Patent
Minard et al.

(10) Patent No.: US 7,956,816 B2
(45) Date of Patent: Jun. 7, 2011

(54) COMPACT PORTABLE ANTENNA FOR DIGITAL TERRESTRIAL TELEVISION WITH FREQUENCY REJECTION

(75) Inventors: Philippe Minard, Saint Medard sur Ille (FR); Jean-Francois Pintos, Bourgbarre (FR); Ali Louzir, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 288 days.

(21) Appl. No.: 12/227,245

(22) PCT Filed: May 4, 2007

(86) PCT No.: PCT/FR2007/051226

§ 371 (c)(1),
(2), (4) Date: Nov. 12, 2008

(87) PCT Pub. No.: WO2007/135312

PCT Pub. Date: Nov. 29, 2007

(65) Prior Publication Data

US 2009/0231222 A1 Sep. 17, 2009

(30) Foreign Application Priority Data

May 12, 2006 (FR) ..... 06 04270

(51) Int. Cl.
*H01Q 9/16* (2006.01)

(52) U.S. Cl. ..... 343/793; 343/802; 343/767; 343/730

(58) Field of Classification Search ..... None
See application file for complete search history.

(56) References Cited

U.S. PATENT DOCUMENTS

| | | | | |
|---|---|---|---|---|
| 4,313,119 | A * | 1/1982 | Garay et al. | 343/702 |
| 6,603,439 | B2 * | 8/2003 | Ngo Bui Hung et al. | 343/793 |
| 7,262,740 | B2 * | 8/2007 | Tikhov et al. | 343/770 |
| 7,301,501 | B2 * | 11/2007 | De Vos et al. | 343/702 |
| 2006/0290569 | A1 * | 12/2006 | Boyle | 343/700 MS |

FOREIGN PATENT DOCUMENTS

| | | |
|---|---|---|
| EP | 0274592 | 7/1988 |
| EP | 1215754 | 6/2002 |
| EP | 1258943 | 11/2002 |
| EP | 1523061 | 4/2005 |
| WO | WO 96/24963 | 8/1996 |
| WO | WO 03/071631 | 8/2003 |

OTHER PUBLICATIONS

Search Report Dated Aug. 20, 2007.

* cited by examiner

*Primary Examiner* — Trinh V Dinh

(74) *Attorney, Agent, or Firm* — Robert D. Shedd; Jeffrey M. Navon

(57) ABSTRACT

The invention relates to a portable compact antenna formed from a first dipole type radiating element operating in a first frequency band and comprising a first and at least one second conductive arm, differentially supplied, the first arm, referred to as cold arm, forming at least one cover for an electronic card and the second arm, referred to as hot arm, being linked to the cold arm at the level of the supply. According to the invention, the hot arm comprises at least one slot resonating in a second frequency band such as the GSM band.

9 Claims, 8 Drawing Sheets

COMPACT PORTABLE ANTENNA FOR DIGITAL TERRESTRIAL TELEVISION WITH FREQUENCY REJECTION

This application claims the benefit, under 35 U.S.C. §365 of International Application PCT/FR2007/051226, filed May 4, 2007, which was published in accordance with PCT Article 21(2) on Nov. 29, 2007 in French and which claims the benefit of French patent application No. 0604270, filed May 12, 2006.

The present invention relates to a portable compact antenna, more particularly an antenna designed to receive television signals, notably the reception of digital signals on a portable electronic device such as a portable computer, a PDA (Personal Digital Assistant) or any other similar device requiring an antenna to receive electromagnetic signals.

On the current accessories market, there are items of equipment that can receive signals for terrestrial digital television (TNT) directly on a laptop computer. The reception of terrestrial digital television signals on a laptop computer can benefit from the computation power of the said computer to decode a digital image, particularly for decoding a flow of digital images in MPEG2 or MPEG4 format. This equipment is most frequently marketed in the form of a unit with two interfaces, namely one RF (radiofrequency) radio interface for connection to an interior or exterior VHF-UHF antenna and a USB interface for the connection to the computer.

The devices currently on the market are generally constituted by a separate antenna such as a whip or loop type antenna mounted on a unit carrying a USB connector.

In the French patent no. 05 51009 submitted on 20 Apr. 2005, the applicant proposed a compact wideband antenna covering the entire UHF band, constituted by a dipole type antenna. This antenna is associated with an electronic card that can be connected to a portable device, notably by using a USB type connector.

More specifically, the antenna described in the French patent application no. 05 51009, comprises a first and a second conductive arm supplied differentially, one of the arms, called first arm, forming at least one cover for an electronic card. Preferably, the first arm has the form of a box into which the electronic card, comprising the processing circuits of the signals received by the dipole type antenna, is inserted. These circuits are most often connected to a USB type connector enabling the connection to a laptop computer or any other similar device. Refinements to this antenna notably enabling diversity to be obtained have been proposed in the French patent application no. 05 52401 submitted on 1 Aug. 2005 in the name of the applicant.

Moreover, in the French patent application submitted on the same day as the present application and having for its title "Portable compact antenna for terrestrial digital television", a description is given of a new embodiment of the hot arm that is constituted by a U-shaped conductive element realized on an insulating substrate and that can comprise between the branches of the U-shaped element, a second radiating element operating in the VHF band.

The solutions proposed in the aforementioned patent applications dedicated to the portable reception of terrestrial digital television (TNT) experience interference with the cellular telephony GSM system.

Several reasons are at the origin of this problem:

1. The GSM emission band (880-915 MHz) is close to the upper limit of the UHF band (862 MHz). Indeed, in contrast to the DVB-H systems, where it has been decided to limit the UHF broadcast band for these systems at the high frequency of 698 MHz, for the broadcast of TNT in DVB-T, all the UHF channels and therefore the highest channels can be used.

2. The large difference in levels emitted by cellular phones (in principle ERIP (Equivalent Radiated Isotropic Power) of 2 Watt=33 dBm are authorised) in relation to the sensitivity of the portable TNT receivers (around −80 dBm).

3. Moreover, in a portable situation, and particularly in order to ensure a reception within a premises, namely "indoors" where the signal experiences fading linked to multiple paths and an additional attenuation for penetrating within the buildings, it is sought to improve the sensitivity threshold of the receiver by adding a low noise amplifier: LNA (Low Noise Amplifier) at the input of the TNT receiver. The presence of this amplifier increases the risk of saturating the receiver.

4. The massive use of portable phones increases the probability of being located near a GSM emitter. In addition, the use of quasi-omnidirectional pattern antennas for the portable reception of TNT, increases the chances of capturing GSM signals.

A first solution for attenuating this problem of interference with the GSM systems may consist in placing a filter at the input of the receiver, enabling the GSM band to be rejected. However, this low-pass or notch filter is not easy to realize owing to:

i) the extreme proximity of the band to reject from the top of the useful UHF band, that imposes a very high rejection factor for this filter (very high order of the filter ≧11 poles)

ii) the requirement for this filter to be compact to be able to include it within the USB key. Indeed, the higher the required rejection, the larger the size of the filter.

Moreover, the use of a filter with a high rejection of the GSM band means that the frequencies located in the top of the UHF band also undergo attenuation.

The present invention therefore propose an antenna solution notably complying with the constraints of size and UHF and VHF band reception and enabling the rejection of an emission frequency band close to these bands, such as the GSM band.

Hence, present invention relates to a portable compact antenna formed from a first dipole type radiating element operating in a first frequency band and comprising a first and at least one second conductive arm, differentially supplied, the first arm, referred to as cold arm, forming at least one cover for an electronic card and the second arm, referred to as hot arm, being linked to the cold arm at the level of the supply. According to a characteristic of the present invention, the hot arm comprises at least one slot forming a filter etched in the conductive part of the hot arm and dimensioned to resonate in a second frequency band. The use of a slot as defined above enables a rejection to be obtained at the resonant frequency by modifying the current distribution at this particular frequency in such a manner as to cancel out the initial radiation of the antenna and thus enable its rejection.

According to a preferential embodiment, the slot is a U-shaped slot etched in the conductive part of the hot arm, this conductive part being able to be constituted by a U-shaped element realized on an insulating substrate as described in the French patent application submitted on the same day and the present application and having for its title "Portable compact antenna for terrestrial digital television".

To obtain a resonance at a specific frequency, the total length of the slot is noticeably equal to $\lambda g/2$ where $\lambda g$ is the guided wavelength in the slot with $\lambda g=\lambda 0/\sqrt{\epsilon reff}$ with $\epsilon reff$ the equivalent permittivity of the material seen by the slot.

According to a particular embodiment, the first frequency band is the UHF band (band between 470 and 862 MHz) and the second frequency band is the GSM band (band between 880 and 915 MHz).

According to other characteristics of the present invention enabling the rejection in the second frequency band to be enlarged and/or improved, the hot arm comprises several slots of different length such that each of the slots resonates a different frequencies, etched in the conductive part of the hot arm, which enables the enlargement of the rejection of the second frequency band. According to another solution, the extremity of the slot can be modified so that it terminates in two slots of different lengths. In this case the slot resonates at two close frequencies, which enables the enlargement of the rejection band.

According to yet another characteristic of the present invention, when the second arm is realized by a conductive U-shaped element in which the slot is etched, a second radiating element constituted by a conductive element folded in bends, as described in the French patent application submitted on the same day as the present application, can be realized between the branches of the conductive U-shaped element. In this case, the second radiating element is dimensioned to operate in a third frequency band such as the VHF band, more particularly VHF-III (174-225-230 MHz).

Other characteristics and advantages of the invention will appear upon reading the description of different embodiments, this description being realized with reference to the enclosed drawings, wherein.

FIGS. 15, 16, 17, 18 and 19 showing embodiment variants of an antenna in accordance with the invention.

Figure 20:
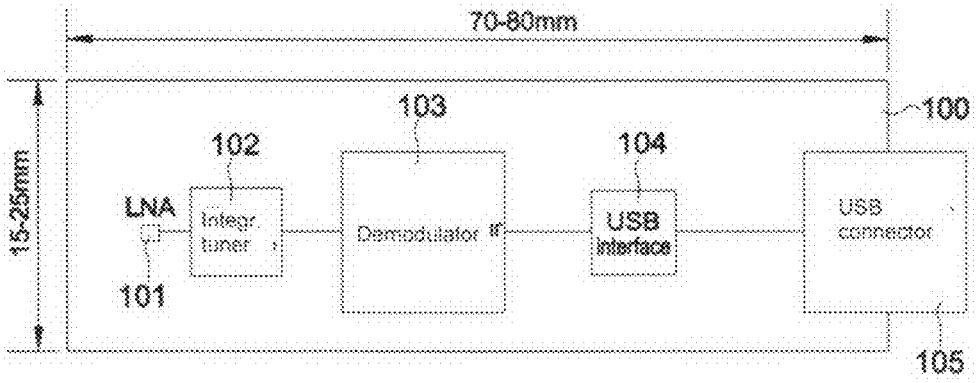

FIG. 20 is a diagrammatic representation of an electronic card used with the antennas in accordance with the present invention.

To simplify the description, the same elements have the same references as the figures.

Figure 1:
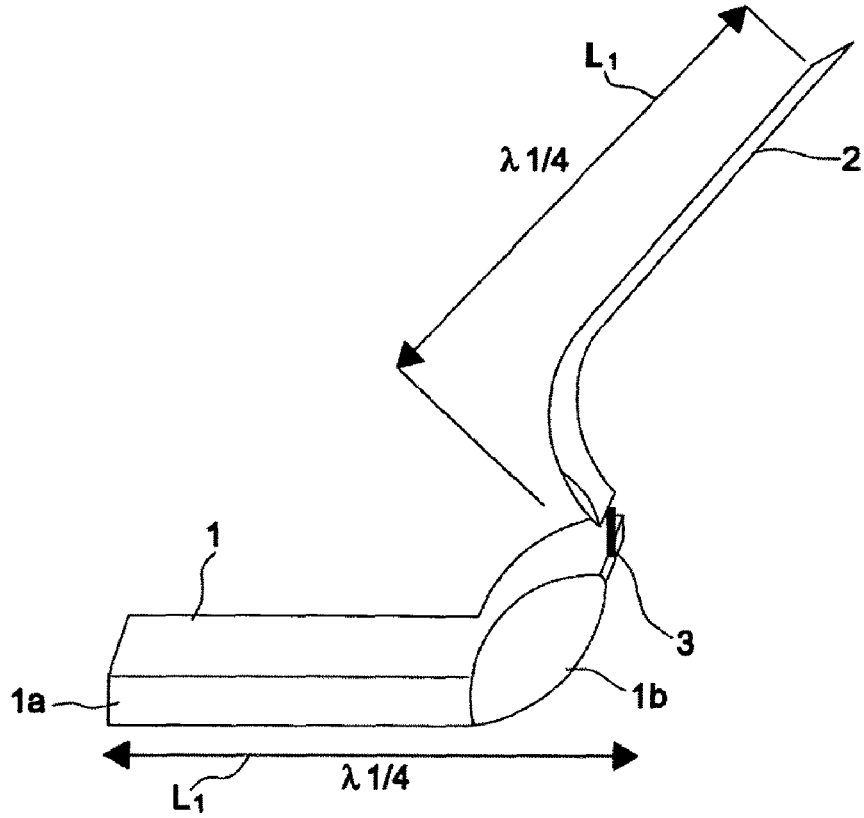
FIG. 1 is a diagrammatic perspective view of an antenna as described in the French patent no. 05 51009 in the name of the applicant.

With reference to FIG. 1, a description will first be made of an embodiment of a dipole type antenna that can be used for receiving terrestrial digital television on a laptop computer or similar device, as described in the French patent application no. 05 51009 submitted in the name of the applicant.

As shown in FIG. 1, this dipole type antenna comprises a first conductive arm 1 also known as cold arm and a second conductive arm 2 also known as hot arm, both arms being connected to each other by means of an articulation zone 3 located at one of the extremities of each of the arms.

More specifically, the arm 1 noticeably has the shape of a box notably being able to receive an electronic card for which an embodiment will be described subsequently. The box has a part 1*a* of a noticeably rectangular form, extending by a curved part 1*b* opening out gradually so that the energy is radiated gradually, which increases the impedance matching over a wider frequency band. The length L1 of the arm 1 is noticeably equal to $\lambda 1/4$ where $\lambda 1$ is the wavelength at the central operating frequency. Hence, the length L1 of arm 1 approaches 112 mm for an operation in the UHF band (frequency band between 470 and 862 MHz).

As shown in FIG. 1, the antenna comprises a second arm 2 mounted in rotation around the pin 3 which is also the point of connection of the antenna to the signal processing circuit, namely to the electronic card not shown inserted into the box formed by the arm 1. The electrical connection of the antenna is made by a metal strand, for example a coaxial or similar cable, whereas the rotation pin is made of a material relatively transparent to electromagnetic waves.

As shown in FIG. 1, the arm 2 that can be articulated around the pin 3 has a length L1 noticeably equal to $\lambda 1/4$. The arm 2 also has a curved profile followed by a flat rectangular part enabling it to be folded back fully against the arm 1 in closed position. The arm 2 being mounted in rotation at 3 with respect to the arm 1, this enables the orientation of the arm 2 to be modified so as to optimise the reception of the television signal.

Figure 2:
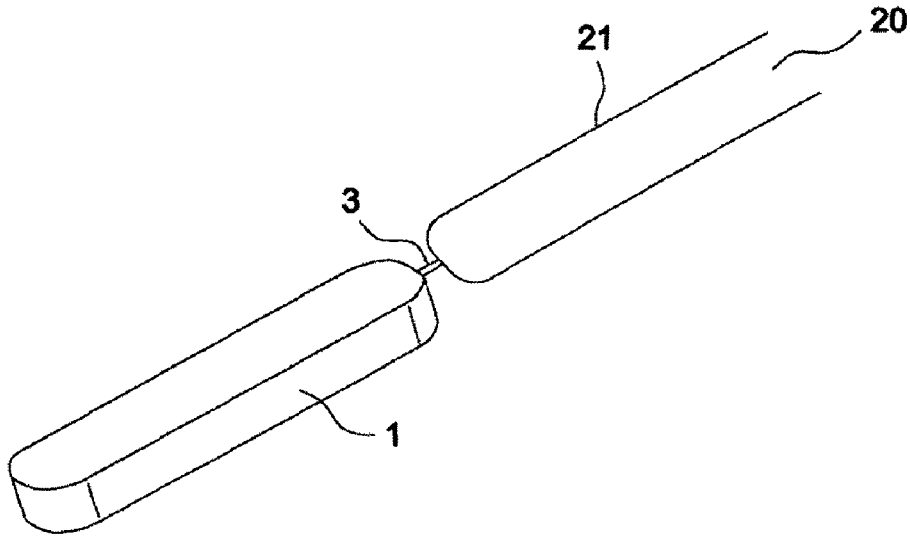
FIG. 2 is a diagrammatic perspective view of a first embodiment of an antenna such as the one of FIG. 1.

With reference to FIG. 2, another embodiment of a dipole type antenna will now be described, this embodiment being the subject of the patent application submitted on the same day and the present application and having for its title "Portable compact antenna for terrestrial digital television".

As shown in FIG. 2, the antenna comprises a first arm 1 called the cold arm having the form of a box and a second arm, called the hot arm, connected to arm 1 by an articulation 3. In this case, the hot arm is constituted by a U-shaped element 21 in a conductive material, realized on an insulating substrate 20. According to a non-restrictive embodiment, the substrate is comprised of a material known as "KAPTON" covered with a layer of copper that is etched to realize the U-shaped element.

As described above, the cold arm and the hot arm each have a length L1 noticeably equal to $\lambda 1/4$ where $\lambda 1$ represents the wavelength at the operating central frequency. Hence, each branch of the U 21 has a length that is noticeably equal to $\lambda 1/4$.

As clearly shown on FIG. 2, the U-shaped element is linked at the level of the articulation 3, by an electric connection element such as a metal strand, to an electronic card not shown, inserted into the box formed by the cold arm 1. Hence the antenna of FIG. 2 is dimensioned to operate in the UHF band.

A description will now be given, with reference to FIG. 3, of a first embodiment of a compact antenna in accordance with the present invention. This antenna thus comprises a first arm 1 or cold arm having, like the cold arm 1 of FIGS. 1 and 2, the shape of a box in a conductive material being able to receive an electronic card. The cold arm 1 extends by a second arm, referred to as hot arm that, in the embodiment shown, is of the same type as the hot arm 20 of FIG. 2. In a more specific manner, the hot arm 20 is constituted by a U-shaped conductive element 21 realized on an insulating substrate. As an example, the U-shaped conductive element 21 can be etched into the metal layer covering a "Kapton" substrate. This hot arm 20 is connected in rotation to the cold arm 1 by means of a pin 3, at the level of which the electrical connection is made. To operate at the UHF band, that is to receive the terrestrial digital television (TNT) signals, the arms 1 and 20 are dimensioned as shown for FIGS. 1 and 2. In accordance with an embodiment of the present invention, a slot 40 is realized on the U-shaped conductive element 21 of the hot arm 20. This slot is dimensioned to resonate in a narrow band around a given frequency, namely the GSM frequency in one embodiment of the invention. More specifically, the slot 40 is a U-shaped slot following the U-shaped form of the conductive element 21. The total electric length of the slot is approximately equal to $\lambda g/2$ where $\lambda g$ the guided wavelength in the slot is such that $\lambda g=\lambda 0/\sqrt{\epsilon reff}$ with $\epsilon reff$ the equivalent permittivity of the material seen by the slot. In addition, the width of the slot enables the rejection level to be adapted.

Figure 3:
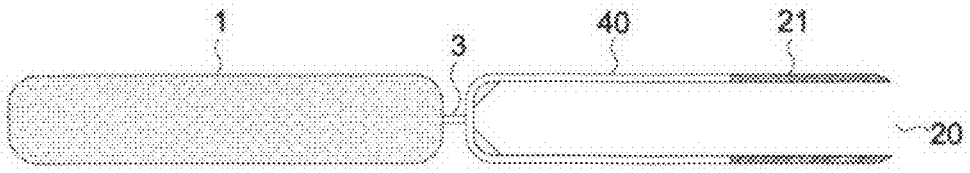
FIG. 3 is a diagrammatic perspective view of a first embodiment of an antenna in accordance with the present invention.
Figure 4:
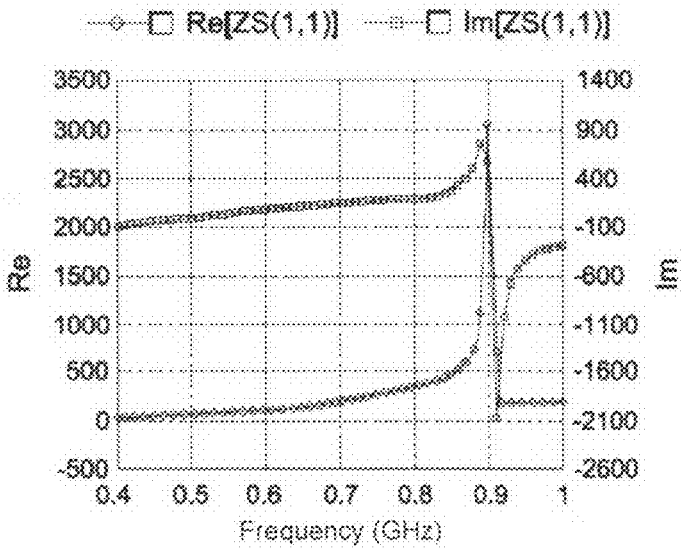
FIG. 4 shows the real and imaginary parts of the antenna of FIG. 3 simulated in the frequency band 400 MHz-1000 MHz.

The antenna of FIG. 3 was simulated on the electromagnetic software IE3D that is based on the moments method, in the frequency band (400 MHz-1000 MHz). The results of the simulation are shown in FIG. 4 that shows the real and imaginary parts of the antenna, showing a resonance at 900 MHz.

Figure 5:
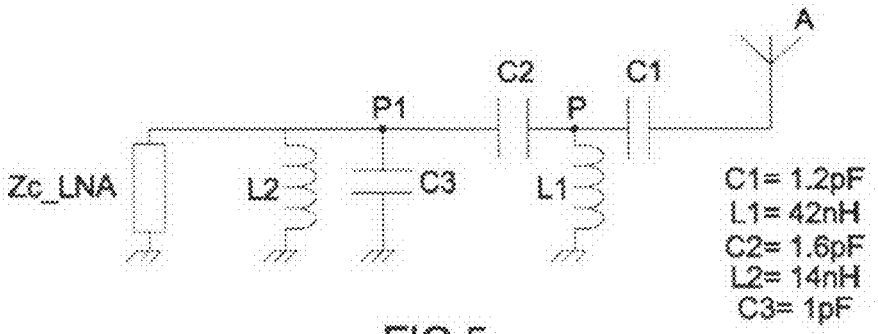
FIG. 5 is a diagrammatic view of an impedance matching circuit at the antenna output.

Additional simulations have been carried out by using, between the antenna and the low noise amplifier of the electronic card, an impedance matching circuit as shown in FIG. 5. This circuit comprises a capacitor C1 of 12 pF mounted in series between the antenna output A and a point p, a self-impedance L1 of 42 nH mounted between the point p and the ground, a second capacitor C2 of 1.6 pF mounted in series between the point p and a connection point p1 to the LNA of the electronic card and a parallel LC circuit formed by a capacitor C3 of 1 pF and a self-impedance L2 of 14 nH, mounted between the point p1 and the ground.

Figure 6:
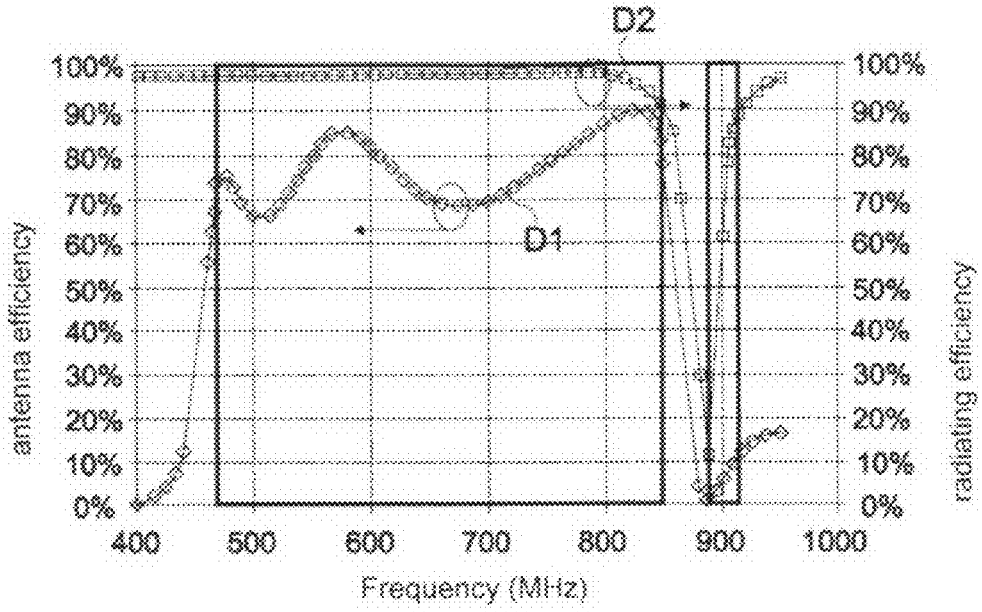
FIG. 6 shows the efficiency curves of the antenna of FIG. 3.
Figure 7:
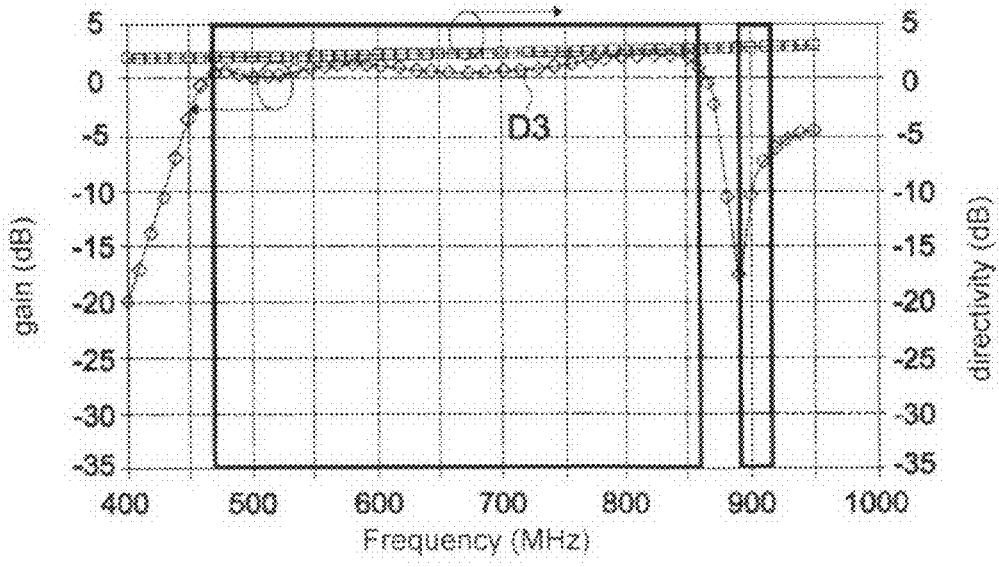
FIG. 7 shows the gain and directivity curves obtained by simulating an antenna in accordance with FIG. 3.

The simulations realized with the antenna of FIG. 3 and the impedance matching circuit of FIG. 5 have given the efficiency, gain and directivity curves shown in FIGS. 6 and 7. The curve D1 of FIG. 6 shows that the total efficiency of the antenna in the UHF band with the impedance matching cell is greater than 65% with a very good reception of the GSM band as the efficiency around 900 MHz is comprised between 1 and 10%. The curve D2 shows a rejection around 900 MHz coming from the radiating efficiency of the antenna. Furthermore, the curve D3 of FIG. 7 shows a gain of the antenna in the neighborhood of 0 dBi in the UHF band and a rejection between 10 dB and 20 dB around the GSM band, namely almost 900 MHz.

Figure 8:
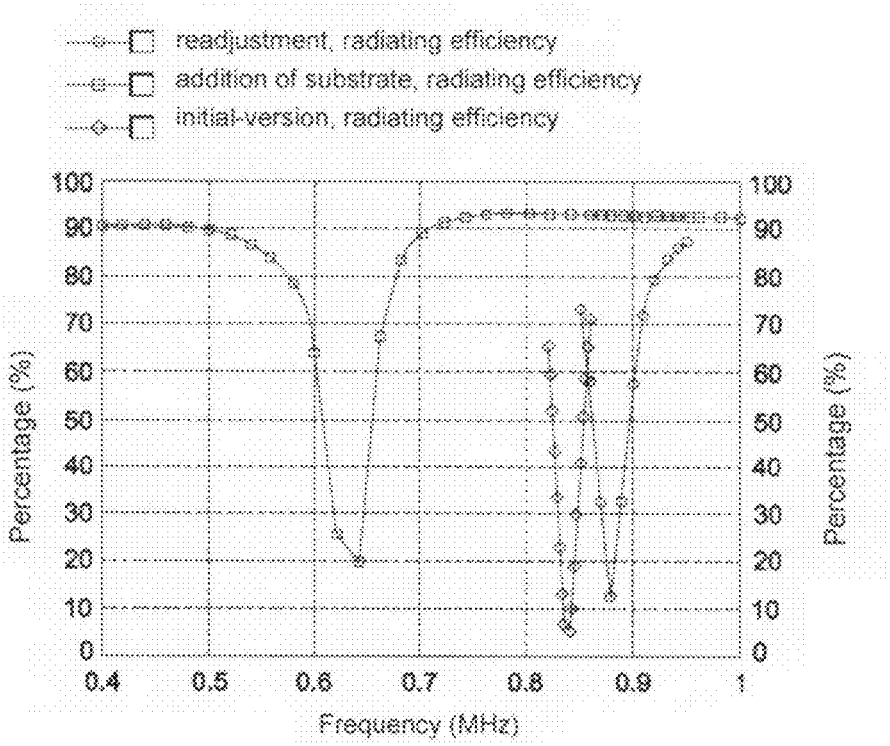
FIG. 8 shows the shift of the efficiency of the antenna provided by the slot in accordance with the present invention.

In fact, the simulations realized show that it is necessary to re-centre the rejection band around 900 MHz. It is, in fact, necessary to account for the technology used to realize the device, in particular the permittivity of the materials used to realize the second arm. The results given in FIG. 8 show, in the case of a plastic material of thickness 1 mm and relative permittivity Er equal to 3, the shift of the radiating efficiency of the antenna provided by the U-shaped slot toward the low frequencies in relation to a slot etched on a material of relative permittivity $\epsilon r=1$ and the re-centering obtained by taking into account a permittivity equivalent to 1.2 for a slot of width 1 mm and whose total length is less than the theoretical length.

This phenomenon may be explained in the following manner:

As the length of the antenna depends on $\epsilon eff$ if the design is made in the air, the length of the slot is $\lambda 0/2$. For a plastic added around the slot, $\epsilon eff$ is no longer 1 but, for example, 2 (mixture between $\epsilon r$ of the air and $\epsilon r$ of the plastic. Hence, for a same physical length of the slot, said length is electrically greater and its resonant frequency lower. To correct this problem, it is enough to reduce the length of the slot to readjust it to the correct resonant frequency.

With reference to FIGS. 9 to 14, a description will now be given of a second embodiment of the present invention also enabling operation in a third frequency band such as the VHF band. This embodiment proposes, as in the French patent submitted on the same day as the present invention, to realize between the branches of the U-shaped conductive element of the hot arm, a second radiating element constituted by a conductive element folded into bends. This conductive element is dimensioned to operate in the VHF frequency band, more particularly the VHF-III frequency band (174-230 MHz). Hence, the total electrical length of the conductive element in bends is equal to $k*\lambda 2/2-L1$ where $\lambda 2$ is the wavelength of the central frequency of the third frequency band, L1 the length of the cold arm and k a positive integer representing a harmonic of the third frequency band. In the embodiment shown in FIG. 9, the antenna comprises a cold arm 1 for which only one part is shown, and a hot arm 20, the two arms being realized by the articulation 3 at the level of the connection to the operating circuits. The hot arm 20 comprises, on an insulating substrate, a U-shaped conductive element 21 in which a U-shaped slot 40 has been etched, just as for the embodiment of FIG. 2. In accordance with this embodiment, a conductive element 50 in bends is realized between the branches of the U-shaped conductive element 21. In this case, the element 50 in bends is shaped such that the parts 50' of the bend having the smallest length are parallel to the branches 21, as the orthogonal directions of the currents circulating in the bends and in the edges of the U-shaped conductor greatly reduce the coupling. This is confirmed by the simulation results shown by the curve of FIG. 10 that gives the efficiency of the antenna of FIG. 9.

Figure 11:
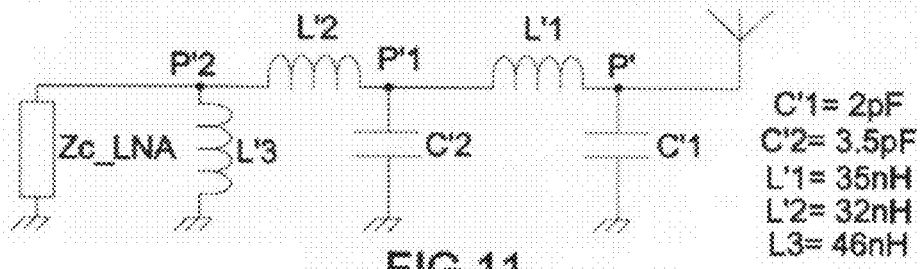
FIG. 11 is a diagrammatic view of an impedance matching circuit used with the antenna of FIG. 9.

Moreover, to optimise the results in the three frequency bands, an impedance matching circuit as shown in FIG. 11 is mounted between the antenna A and the low noise amplifier LNA.

The impedance matching circuit comprises a capacitor C'1 of 2 pF mounted between the output point p' of the antenna and the ground, a self-impedance L'1 of 35 nH mounted in series between the point p' and a point p'1, a second capacitor C'2 of 35 pF mounted between the point p'1 and the ground, a second self-impedance L'2 mounted between the point p'1 and a connection point p'2 to the LNA amplifier and a third self-impedance L'3 mounted between the point p'2 and the ground.

Figure 9:
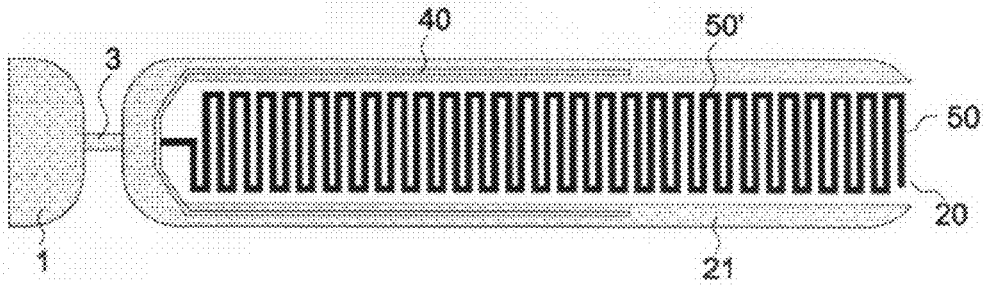
FIG. 9 represents a second embodiment of an antenna in accordance with the present invention and operating in the UHF and VHF band with GSM rejection.
Figure 10:
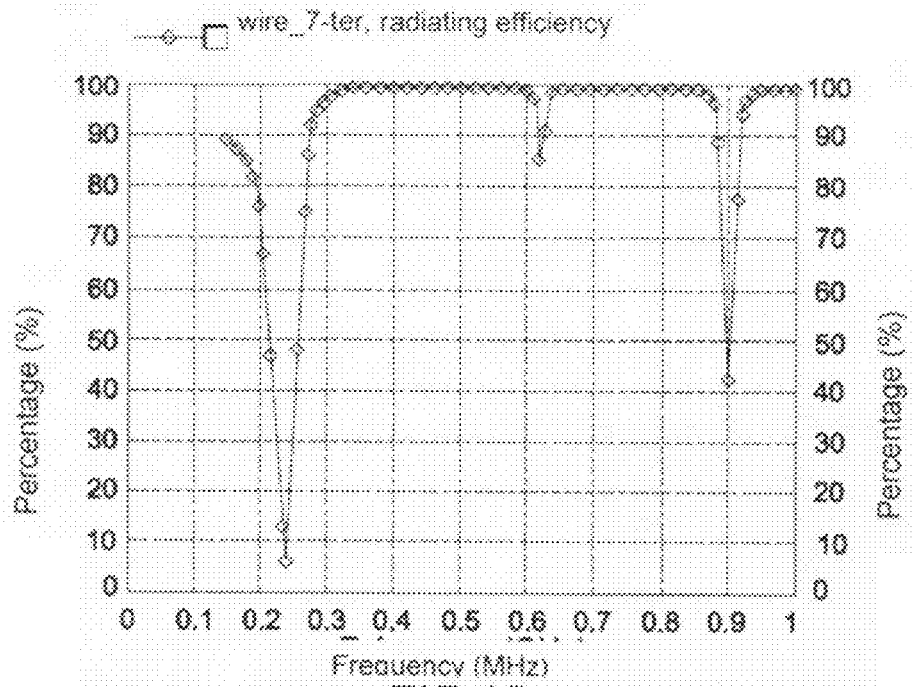
FIG. 10 shows the radiation efficiency of the antenna of FIG. 9.
Figure 12:
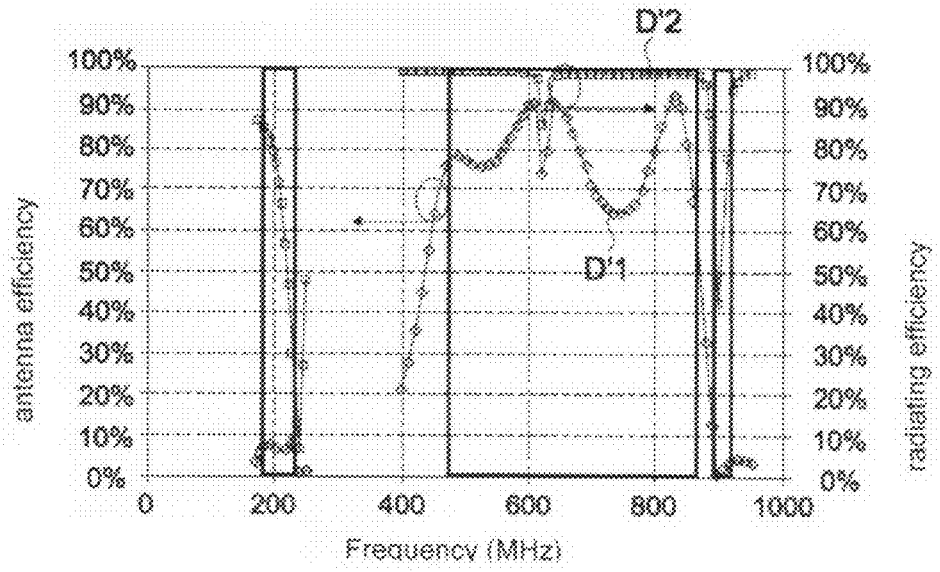
FIG. 12 shows the efficiency curves of the antenna of FIG. 10.

In FIG. 12, the curve D'1 shows the efficiency of the simulated antenna of FIG. 9 with the impedance matching circuit of FIG. 11. An efficiency of greater than 65% is therefore obtained with a good rejection around 900 MHz (GSM band). The curve D2 represents the rejection obtained around 900 MHz and coming from the radiating efficiency of the antenna.

Figure 13:
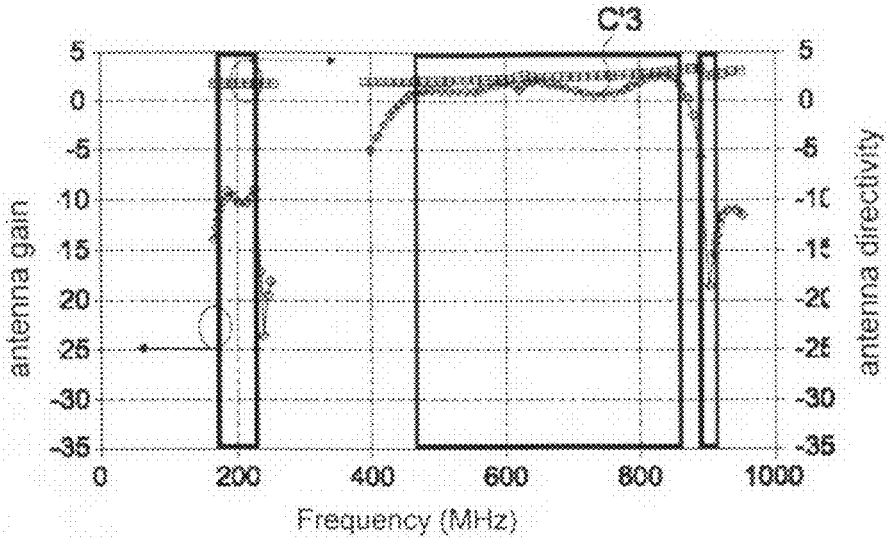
FIG. 13 shows the gain and directivity curves of the antenna of FIG. 10.
Figure 14:
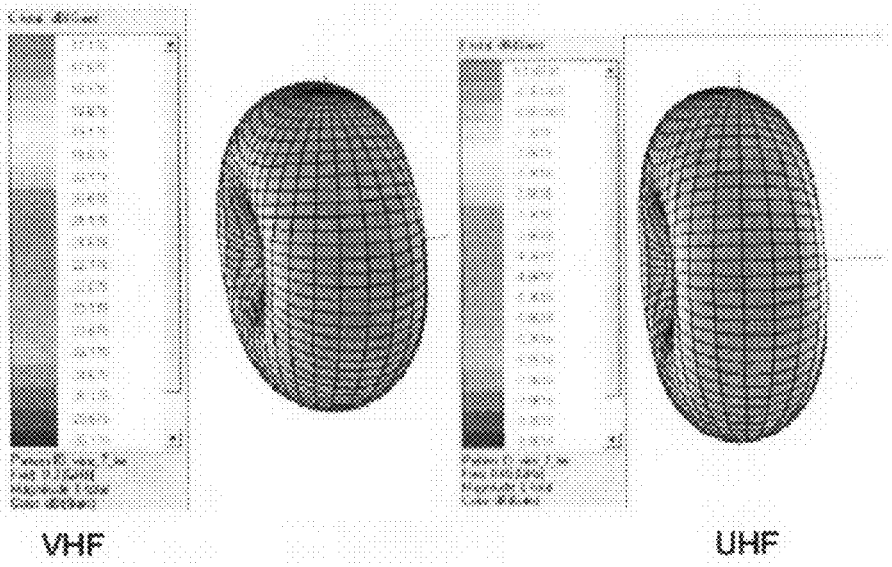
FIG. 14 shows the radiation patterns respectively in the UHF and VHF bands, obtained by simulating an antenna according to FIG. 10.

In FIG. 13, the curve C'3 shows a gain of the antenna in the neighborhood of 0 dB in the UHF band, a rejection between 10 dB and 20 dB in the GSM band around 900 MHz and a gain in the order of −10 dBi in the VHF band. Furthermore, FIG. 14 shows the radiation patterns in the VHF band and in the UHF band of the simulated antenna of FIG. 9. These patterns show the omnidirectional nature of the radiation of the antenna.

Figure 15:
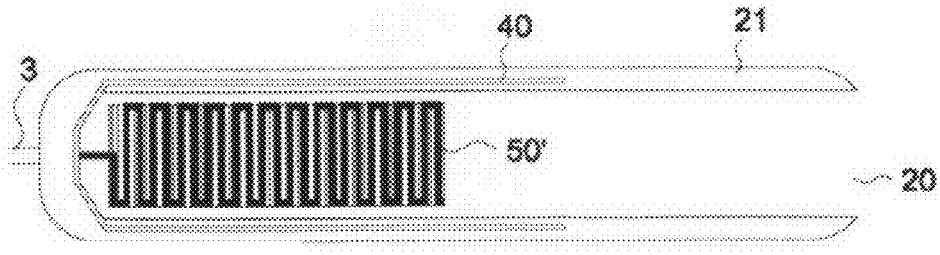
Figure 16:
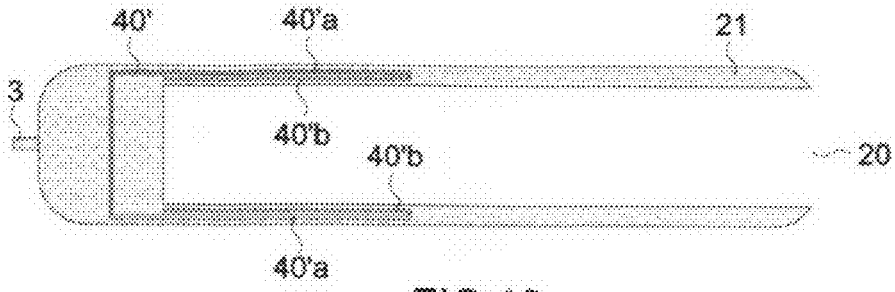
Figure 17:
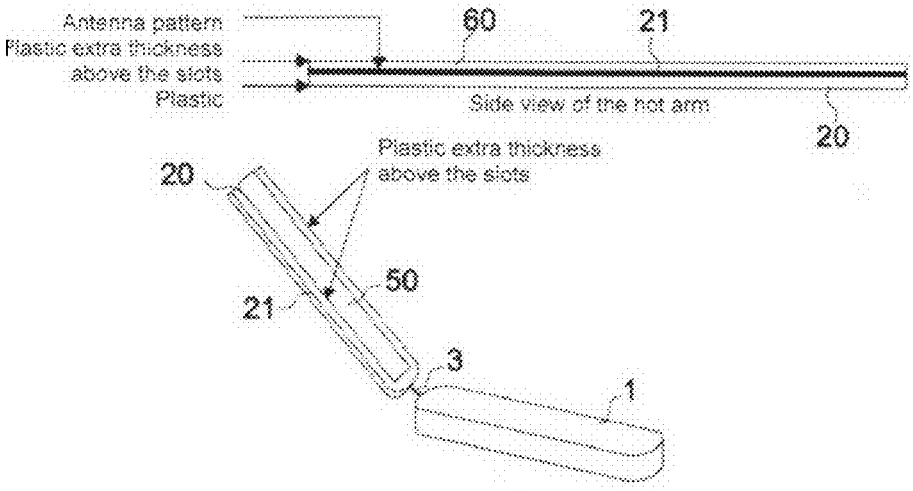

FIGS. 15 to 17 show different embodiment variants of an antenna in accordance with the invention.

In FIG. 15, the second radiating element 50' is formed by a conductive element in bends of which the distance between the bends is modified. In this case, the length of the zone 50' is reduced and can limit the coupling between this zone and the branches of the U-shaped conductive element 21.

In FIG. 16, the slot 40' realised in the U-shaped conductive element 21 is etched such that the part of the slot being found in each branch is folded in such a manner as to form two slot elements 40'A and 40'B in parallel. This solution enables surface area to be increased on the upper part of the branches of the U-shaped element. This involves a more compact variant of the slot in the branch of the U.

FIG. 17 respectively shows a perspective view of another embodiment of an antenna in accordance with the invention together with a longitudinal section of the hot arm. In this case, in a plastic substrate 20, the two antenna patterns are realized, namely the U-shaped conductive element 21 and the second radiating element 50. In accordance with this embodiment, an extra thickness 60 in a plastic material is laid above the slot (not shown) realized in the U-shaped conductive element 21. The other parts of the antenna, namely the cold arm 1 and the articulation zone, are identical to those of FIG. 1 or 2.

Figure 18:
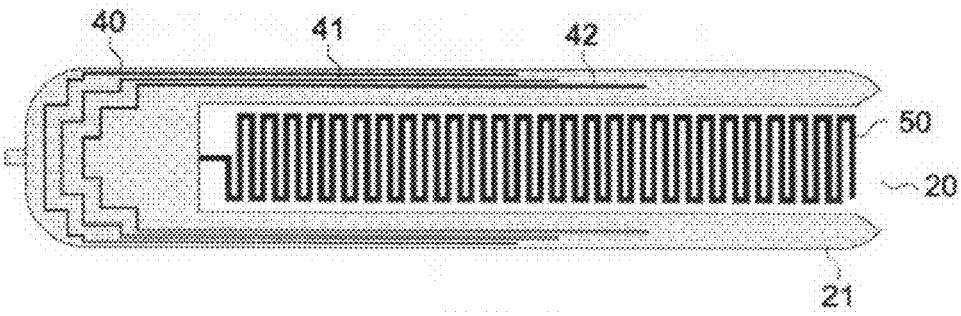
Figure 19:
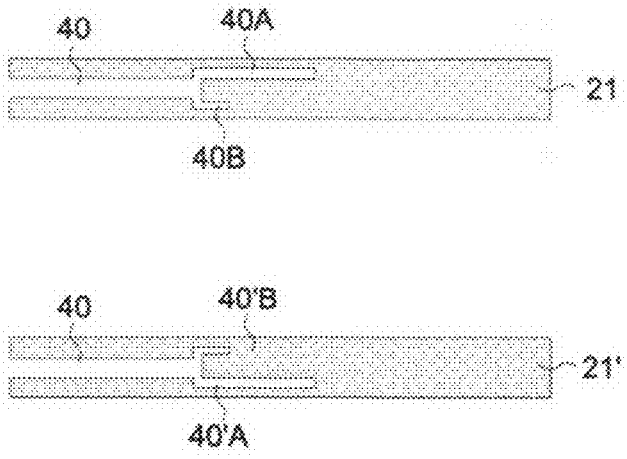

FIGS. 18 and 19 shows embodiment variants of the rejection slot. In FIG. 18, three slots 40, 41 and 42 of different lengths have been etched in the U-shaped conductive element 21 of the hot arm 20 containing a second radiating element 50. The three slots 40, 41 and 42 having different electrical lengths resonate on different frequencies. It is thus possible to widen the rejection of the GSM band.

FIG. 19 shows the extremity of a slot 40 realized on the U-shaped conductive element. In this case, the extremity is divided into two parts 40A and 40B of different length. The slot thus resonates at two frequencies, which enables the width of the rejection band to be enlarged.

Hence, the various non-restrictive embodiments described above can obtain a low cost, transportable compact antenna, such as a USB key, covering the entire UHF band and possibly the VHF-III band while enabling a good resistance to interferences with the cellular telephone GSM system.

With reference to FIG. 20, a description will now be given of an embodiment of an electronic card of dimensions 70-80 mm by 15-25 mm that can be introduced into the box formed by the cold arm 1 and connected to the antenna. This electronic card 100 comprises a low noise amplifier 101 to which is connected the coaxial cable of the antenna at the level of the articulation 3. The LNA 101 is connected to an incorporated tuner 102 processing both the VHF band and the UHF band. The tuner 102 is connected to a demodulator 100 the output of which is connected to a USB interface 104, itself connected to a USB connector 105. It is therefore possible with this system to connect the antenna to the USB input of a laptop computer or any other display element, which particularly enables terrestrial digital television to be received on a computer, PDA or any other portable device.

It is obvious to those in the skilled art that the embodiments described above can be modified, notably with regard to the shape and arrangement of the slots and/or bends that must simply meet the criteria of length, width and spacing given above. Furthermore, to obtain diversity, at least two hot arms having the characteristics described above, are connected to the extremity of the cold arm.

The invention claimed is:

1. A portable compact antenna formed from a first dipole type radiating element operating in a first frequency band and comprising a first and at least one second conductive arm, differentially supplied, said first and second conductive arms each having a first and second extremities and being linked to each other and supplied at a level of one of said first and second extremities, the first arm forming at least one cover for an electronic card wherein the second arm is constituted by a conductive element realized on an insulating substrate and comprises at least one slot forming a filter directly etched in the conductive element of the second arm and dimensioned to resonate in a second frequency band the total length of the slot is noticeably equal to $\lambda g/2$ where the guided wavelength in the slot with $\lambda g=\lambda 0/\sqrt{\epsilon reff}$ with $\epsilon reff$ being the equivalent permittivity of the material seen by the slot, and $\lambda 0$ being the wavelength in the air.

2. Antenna according to claim 1, wherein the slot is a U-shaped slot.

3. Antenna according to claim 1, wherein the second arm comprises several slots of different lengths etched in the conductive part of the second arm.

4. Antenna according to one of claim 1, wherein each slot comprises a first and a second extremities at least one of said first and second extremities being constituted by at least two parallel slot elements of different lengths.

5. Antenna according to claim 1, wherein the first frequency band is the UHF band (band between 470 and 862 MHz) and the second frequency band is the GSM band (band between 880 and 915 MHz).

6. Antenna according to claim 1, wherein the conductive element is U-shaped with two branches, each U branch having a length function of the wavelength $\lambda 1$ at a central operating frequency in the first frequency band.

7. Antenna according to claim 6, wherein an additional radiating element operating in a third frequency band is realized on the second arm between the branches of the U-shaped conductive element.

8. Antenna according to claim 7, wherein the additional radiating element is constituted by a conductive element folded in bends.

9. Antenna according to claim 7, wherein the additional radiating element is dimensioned to operate in the VHF band.

* * * * *